United States Patent [19]

Kotchen

[11] 4,030,220

[45] June 21, 1977

[54] FRAME FOR TEXTILES, NEEDLEWORK AND THE LIKE

[76] Inventor: Deborah L. Kotchen, 108 Gilbert Ave., Rocky Hill, Conn. 06067

[22] Filed: Dec. 29, 1975

[21] Appl. No.: 644,434

[52] U.S. Cl. ..... 40/156; 38/102.91; 40/125 G

[51] Int. Cl.[2] ..... G09F 1/12

[58] Field of Search ..... 40/152, 156, 152.1, 40/152.2, 153, 154, 158 R, 159, 128, 1.5, 125 G, 125 F, 125 H, 125 R, 10 R, 10 D, 63 R; 38/102.2, 102.3, 102.9, 102.91; 160/371, 373, 380

[56] References Cited

UNITED STATES PATENTS

| | | | |
|---|---|---|---|
| 2,623,316 | 12/1952 | Knox | 40/152 |
| 3,559,316 | 2/1971 | Galper | 38/102.91 |
| 3,579,887 | 5/1971 | Rochelt | 40/152.1 |
| 3,787,992 | 1/1974 | Leonhardt | 40/152 |
| 3,842,525 | 10/1974 | Deau | 40/159 |
| 3,864,791 | 2/1975 | Bishop | 40/315 |
| 3,886,990 | 6/1975 | Campione | 38/102.91 |
| 3,898,870 | 8/1975 | Jacobson | 40/156 |
| 3,918,187 | 11/1975 | Vogele | 40/156 |

*Primary Examiner*—John F. Pitrelli
*Attorney, Agent, or Firm*—Howard C. Miskin

[57] ABSTRACT

A frame for needlepoint and the like comprises a rigid rectangular planar base member and a continuous rectangular sidewall extending from one surface thereof to provide a mounting recess, the sidewall being spaced inwardly from the peripheral edges of the base member. A rectangular mounting member seats in the recess with only a small clearance between its edges and the sidewall and provides a mounting for flexible materials having greater length and width dimensions, the material abutting the outer surface of the mounting member and being folded about the edges thereof into contact with its other surface. The combined dimensions of the mounting member and mounted material provide a friction fit within the recess. The frame has a mounting member on the other surface of the base member for mounting it to a wall, and may have a transparent sheet member seated within the recess to protect mounted material.

5 Claims, 2 Drawing Figures

FRAME FOR TEXTILES, NEEDLEWORK AND THE LIKE

BACKGROUND OF THE INVENTION

The most widely used structure for mounting needlepoint or other flexible material for display requires stretching the material over a conventional frame having an open center such as those for canvases, thereafter mounting this combination in a decorative frame. Due to the relative difficulty of satisfactorily framing a fabric in this manner, it is usually necessary to have the work framed by a professional. Furthermore, the fabric may be easily punctured as it is generally not supported over its entire surface. This type of frame also requires purchase of two separate elements, i.e., the fabric mount and decorative frame.

Another type of mount for flexible material is that of U.S. Pat. No. 1,964,462 granted June 26, 1934 to G. Gastrich. His mount utilizes a peripheral support similar to an embroidery hoop which may have a center support for the material. However, it is not suitably constructed for decorative display on a wall or the like as it is specifically adapted for use during testing and analysis of supported fabric.

A serving tray decoratively utilizing a mounted needlepoint is marketed by Needlepoint U.S.A. of New York City. The needlepoint is supported on a rigid sheet and inserted into a box-like structure on the bottom of the tray which is necessarily transparent to permit viewing of the needlepoint. The tray does not provide means for mounting upon a wall.

Accordingly, it is an object of the present invention to provide a novel frame for needlepoint and the like which is readily and relatively economically manufactured and which permits facile mounting of flexible materials to be displayed.

It is also an object of the present invention to provide such a frame which is decorative and wherein displayed materials are easily interchanged.

Another object is to provide such a frame which may be fabricated from synthetic resin sheet materials with minimal equipment.

SUMMARY OF THE INVENTION

It has now been found that the foregoing and related objects of the present invention are readily attained in a frame for needlepoint and the like comprising a substantially planar base member of rigid sheet material and a continuous sidewall extending generally perpendicularly to and from one surface of the base member to define a frame enclosure. The sidewall and portion of the base member circumscribed thereby define a recess in which is seated a mounting member having substantially the same peripheral configuration as the inner surface of the sidewall and being of lesser dimension than the recess. The mounting member provides a functional mounting for flexible material of greater dimension whereby the material to be mounted abuts the outer surface of the mounting member with additional portions thereof being folded about the edges of the mounting member against the inner surface thereof. The combined peripheral configuration of the material and the mounting member provide a friction fit within the recess. Mounting means are secured to the other surface of the base member for mounting the frame upon a wall or the like.

In the preferred aspect, the sidewall, base member and mounting member are of rectangular configuration with the sidewall spaced inwardly from the peripheral edges of the base member. A protective member of transparent sheet material having substantially the same peripheral configuration and dimensions as the inner surface of the sidewall is seated within the recess outwardly of the mounting member and material. The sidewall and base member are opaque.

DETAILED DESCRIPTION OF THE ILLUSTRATED EMBODIMENT

Figure 1:
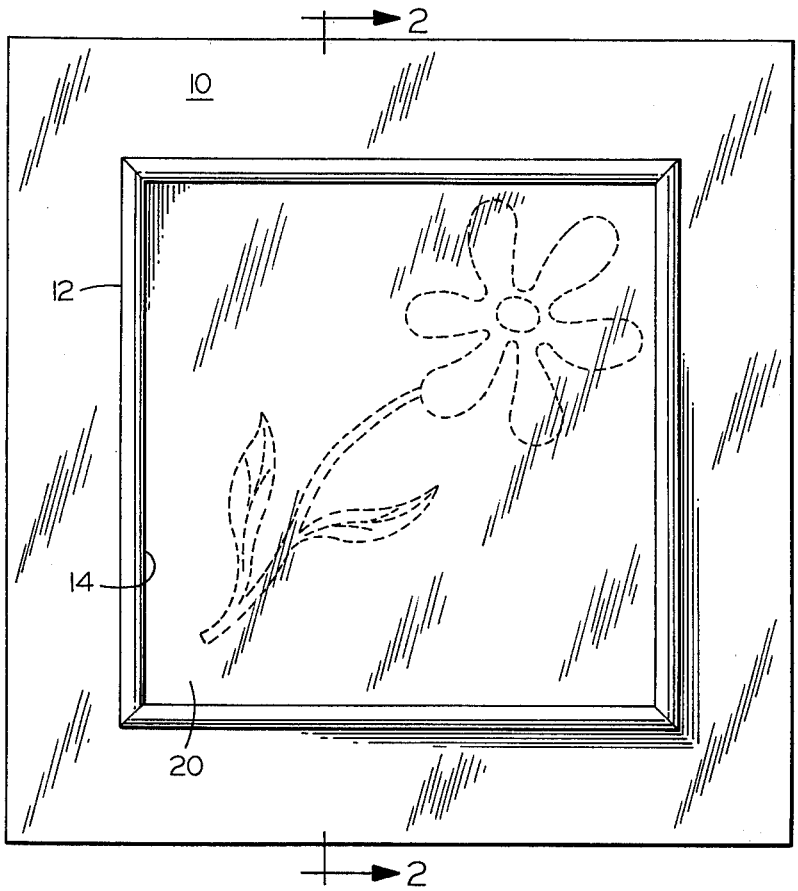
FIG. 1 is a front elevational view of a frame embodying the present invention and showing a needlepoint fabric mounted therein.

Turning now to the attached drawing in detail, illustrated therein is a frame embodying the present invention which comprises a square base member 10 of rigid synthetic resin sheet material which has a four piece continuous square sidewall or box frame 12 secured to one surface thereof cooperating with the base member 10 enclosed thereby to define a seating recess 14. The base member 10 is of considerably greater dimension than the sidewall 12 so as to extend outwardly thereof to provide a border thereabout, and a square mounting member 16 of substantially rigid sheet material seats in the recess 14 with a small clearance between its edges and the inner surface of the sidewall 12 to provide a mount for material to be framed.

Figure 2:
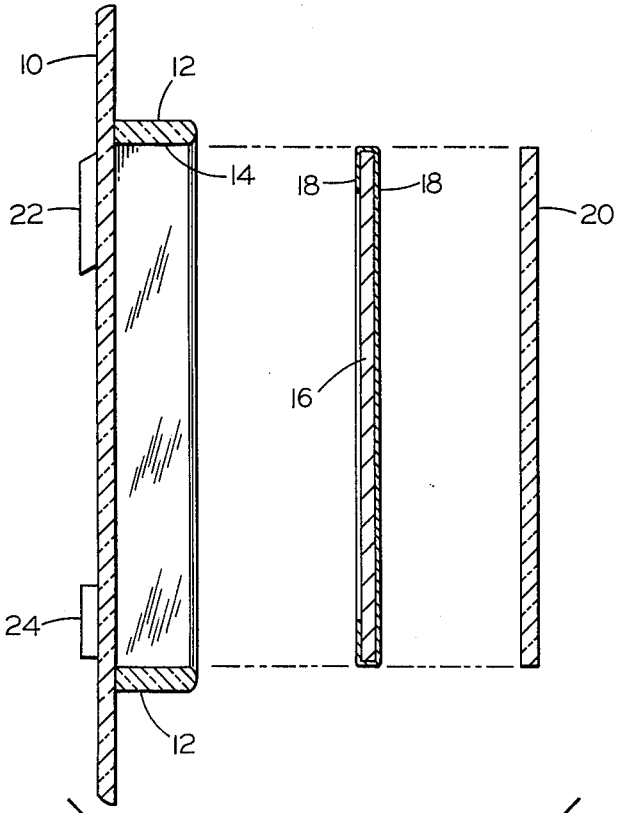
FIG. 2 is a partially exploded sectional view along the line 2—2 of FIG. 1.

As seen in FIG. 2, a needlepoint fabric 18 or other flexible material of greater dimension than the mounting member 16 is secured in the frame by placing it against the outwardly facing surface of the mounting member 16, folding it about the edges of the member 16 into contact with the other surface thereof, and, if necessary to facilitate mounting the needlepoint 18, securing the edge portions thereof to the other surface of the member 16 by tape, staples, or other fastening means (not shown). The combination is then inserted into the recess 14, the mounting member 16 being dimensioned so that the combined peripheral configuration of the member 16 and needlepoint 18 provides a friction fit within the recess 14. A transparent protective member 20 of substantially rigid synthetic resin sheet material is dimensioned to snugly conform to the dimensions of the inner surface of the sidewall 12 and is seated within the recess 14 to provide a protective cover for the needlepoint 18.

A mounting member 22 is secured to the rear surface of the base member 10 and provides an upwardly and inwardly inclined lower surface portion for engagement with a hanger or the like (not shown) to hang the frame upon a wall or the like (not shown). A spacer 24 having the same thickness as the mount 22 maintains the base member 10 in parallel disposition relative to a wall.

Removal of the mounting member 16, needlepoint 18, and protective member 20 from within the recess 14 is accomplished by inserting a finger or other object through an aperture (not shown) in the base member 10 from the rear thereof and pushing these elements out of the recess 14. Alternatively, if no protective member 20 is used the needlepoint 18 and mounting member 16 may be removed by carefully prying them out of the recess 14 using a needle, paper clip or other comparably thin object.

As is apparent from FIG. 2, the recess 14 has sufficient depth so that the mounting member 16 and needlepoint 18 may be disposed at varying depths therewithin according to the preference of the user.

The base member and sidewall are preferably square or rectangular, although they may have virtually any configuration depending on that of the object to be mounted. The base member is shown as being of greater dimension than the sidewall so as to extend thereabout and provide a border, which may be curved or scalloped rather than rectilinear to provide whatever decorative accent is desired. The mounting member is planar to support materials in two dimensions, but may be non-planar to provide a three dimensional support.

The base member and sidewall are preferably formed of synthetic resin sheet material such as polymethyl methacrylate which may be colored or transparent but wood and other materials may be used depending on the desired effect. Exemplary of materials other than needlepoint which may be mounted in the frame are crewel, decorative textiles, patchwork, applique, painted canvas, and prints. The mounting member is preferably formed of cardboard for economy, but may be of a material of greater rigidity if the framing requirements necessitate stretching the material to an appreciable degree.

The protective cover when used may be frictionally engaged within the recess by close dimensioning of the parts or by providing interference tapers on the cooperating surfaces; alternatively it may be secured in position within the recess by adhesive. If so desired, the protective cover may fit over the sidewall and be frictionally or adhesively engaged with the outer periphery thereof.

The hanger mounting means preferably has an upwardly and inwardly inclined lower surface for engagement with a hanger. It may also have abutments on both sides of the inclined surface so that laterial displacement of the frame will be limited and accidental disengagement of the frame from a wall hook will be effectively prevented. Alternatively, the hanger mounting means may have an upwardly extending recess in the inclined surface to facilitate engagement with a hanger.

Thus, it can be seen that the frame of the present invention is readily and relatively economically manufactured and which permits facile mounting of flexible materials to be displayed. The frame is decorative and may be fabricated from synthetic resin sheet materials with minimal equipment, and provides for easily interchanging displayed materials.

Having thus described the invention, I claim:

1. A frame for material to be mounted such as needlepoint and the like comprising:

a. a substantially planar base member of rigid sheet material;

b. a continuous sidewall extending forwardly from and generally perpendicularly to one surface of said base member, said sidewall having inner surfaces circumscribing at least a portion of said base member surface and defining a frame enclosure, said sidewall and the portion of said base member circumscribed thereby defining a seating recess; said side wall is spaced inwardly from the peripheral edge of said base member;

c. a mounting member of relatively rigid generally planar sheet material having a peripheral edge and an inwardly facing surface, said member having substantially the same peripheral configuration as the inner surface of said sidewall and seated therewithin, said mounting member being adapted to provide a functional mounting for flexible material of greater dimension whereby the material to be mounted includes portions to be folded about the peripheral edge of said mounting member against the inwardly facing surface thereof, said mounting member having a dimension slightly smaller than the dimensions of said recess and sufficiently large so that the combined dimensions of said mounting member and the material portions folded about the peripheral edge of said mounting member is slightly greater than the dimensions of the recess so that a friction fit is provided upon seating of said mounting member within said recess; and d. mounting means on the other surface of said base member for mounting said frame upon a wall or the like.

2. The frame of claim 1 wherein said base member, said sidewall, and said mounting member are of rectangular configuration.

3. The frame of claim 1 wherein said base member and said sidewall are opaque.

4. The frame of claim 1 further including a protective member of rigid transparent sheet material having substantially the same peripheral configuration and dimension as said inner surface of said sidewall, said protective member being seated within said recess outwardly of and spaced from said mounting member to accommodate material mounted in said frame.

5. The frame of claim 1 wherein said base member and said sidewall are formed of synthetic resin sheet material.

* * * * *